US008065139B2

(12) United States Patent
Kot

(10) Patent No.: US 8,065,139 B2
(45) Date of Patent: Nov. 22, 2011

(54) METHOD OF AUDIO ENCODING

(75) Inventor: Valery Stephanovich Kot, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1115 days.

(21) Appl. No.: 11/570,508

(22) PCT Filed: Jun. 14, 2005

(86) PCT No.: PCT/IB2005/051963

§ 371 (c)(1),
(2), (4) Date: Dec. 13, 2006

(87) PCT Pub. No.: WO2006/000951

PCT Pub. Date: Jan. 5, 2006

(65) Prior Publication Data

US 2008/0275696 A1 Nov. 6, 2008

(30) Foreign Application Priority Data

Jun. 21, 2004 (EP) ..... 04102819

(51) Int. Cl.
*G10L 19/14* (2006.01)

(52) U.S. Cl. ..... 704/211; 704/201; 704/214; 704/503; 704/504

(58) Field of Classification Search ..... 704/201, 704/211, 214, 503, 504
See application file for complete search history.

(56) References Cited

U.S. PATENT DOCUMENTS 4,667,340 A 5/1987 Arjmand et al.
5,127,054 A 6/1992 Hong et al.
5,886,276 A * 3/1999 Levine et al. ..... 84/603
6,266,644 B1 * 7/2001 Levine ..... 704/503
2002/0120445 A1 * 8/2002 Vafin et al. ..... 704/241
2002/0156619 A1 * 10/2002 Van De Kerkhof et al. .. 704/203
2004/0162721 A1 * 8/2004 Oomen et al. ..... 704/203

FOREIGN PATENT DOCUMENTS

WO WO9857436 A2 12/1998
WO WO0126095 A1 4/2001

OTHER PUBLICATIONS

International Search Report of International Application No. PCT/IB2005/051963 Contained in International Publication No. WO2006000951.

(Continued)

*Primary Examiner* — Leonard Saint Cyr

(57) ABSTRACT

There is described a method of encoding an input signal (20) to generate a corresponding encoded output signal (30), and also encoders (10) arranged to implement the method. The method comprises steps of: (a) distributing the input signal to sub-encoders (300, 310, 320) of the encoder (10); (b) processing the distributed input signal (20) at the sub-encoders (300, 310, 320) to generate corresponding representative parameter outputs (200, 210, 220) from the sub-encoders (300, 310, 320); and (c) combining the parameter outputs (200, 210, 220) of the sub-encoders (300, 310, 320) to generate the encoded output signal (30). Processing of the input signal (20) in the sub-encoders (300, 310, 320) involves segmenting the input signal (20) for analysis, such segments having associated temporal durations which are dynamically variable at least partially in response to information content present in the input signal (20). Such varying segment duration is capable of improving perceptual encoding quality and enhancing data compression achievable.

14 Claims, 4 Drawing Sheets

OTHER PUBLICATIONS

Written Opinion of the International Searching Authority for International Application No. PCT/IB2005/051963.
Princen et al: "Audio Coding With Signal Adaptive Filterbanks"; 1995 International Conference on Acoustics, Speech and Signal Processing, ICASSP-95, vol. 5, pp. 3071-3074.
Verma et al: "A 6KBPS to 85KBPS Scalable Audio Coder"; Acoustics, Speech, and Signal Processing, 2000, ICASSP 2000 Proceedings. 2000 Intl. Conference Jun. 5-9, 2000, Piscataway, NJ, IEEE, vol. 2, Jun. 5, 20000, pp. 877-880, XP010504863.
Purnhagen, H.: "Advances in Parametric Audio Coding"; Applications of Signal Processing to Audio and Acoustics, 1999 IEEE Workshop in New Paltz, NY, Oct. 17-20, 1999, IEEE, Oct. 17, 1999, pp. 31-34, XP010365061.

* cited by examiner

METHOD OF AUDIO ENCODING

FIELD OF THE INVENTION

The present invention relates to methods of encoding audio signals. Moreover, the invention also concerns encoders operating according to the method, and also an arrangement of encoded data generated by such encoders. Furthermore, the invention additionally relates to decoders operable to decode data generated by such encoders. Additionally, the invention also concerns an encoding-decoding system utilizing the methods of encoding.

BACKGROUND TO THE INVENTION

Audio encoders are well known. These encoders are operable to receive one or more input audio signals and process them to generate corresponding bit-streams of encoded output data. Such processing executed within the audio encoders involves partitioning the one or more input signals into segments, and then processing each segment to generate its corresponding portion of data for inclusion in the encoding output data.

Conventional methods of creating such bit-streams employ fixed uniform time segments. Beneficially, the segments are at least partially overlapping. An example of an encoder performing in this manner is Philips Electronics N.V.'s proprietary SSC codec whose mode of operation is now included in a known international standard MPEG 4 extension 2, namely text of ISO/IEC 14496-3:2002/PDAM 2 concerning "Parametric coding for High Quality Audio".

Other methods of encoding audio signals have been proposed. For example, in a published international PCT application no. PCT/SE00/01887 (WO 01/26095), there are described modern audio encoders which employ adaptive window switching, namely the audio encoders switch time segment lengths depending on input signal statistics. In one implementation, non-uniform time and frequency sampling of a spectral envelope of an input signal is achieved by adaptively grouping sub-band samples from a fixed size filter-bank into frequency bands and time segments, each of which generates one envelope sample. This allows for instantaneous selection of arbitrary time and frequency resolution within the limits of the filter-bank. Such encoders preferably default to relatively long time segments and a fine frequency resolution. In the temporal vicinity of signal transients, relatively shorter time segments are used, whereby larger frequency steps can be employed in order to keep data size within limits. Moreover, to enhance benefits from such non-uniform temporal sampling, variable length of bit-stream frames are used.

SUMMARY OF THE INVENTION

The inventors have appreciated that, when encoding audio signals, it is more beneficial in terms of bit-rate and/or perceptual distortion to use variable segmentation, for example as described in the foregoing. For example, it is technically advantageous to use longer segments for steady tones, shorter segments for rapidly changing tones, to start segments immediately preceding transients, and so forth. In particular, the inventors have envisaged that it is further beneficial to employ different time segmentation patterns for different sub-coding methods with the same encoder.

An object of the present invention is to provide an enhanced method of signal encoding utilizing dynamically variable signal segmenting.

According to a first aspect of the present invention, there is provided a method of encoding one or more input signals to generate one or more corresponding encoded output signals, the method comprising steps of:

(a) receiving the one or more input signals and distributing them suitably to sub-encoders of an encoder;

(b) processing the one or more input signals distributed to the sub-encoders in respect of one or more signal characteristics of the one or more distributed input signals to generate corresponding representative parameter outputs from the sub-encoders;

(c) combining the parameter outputs of the sub-encoders to generate the one or more encoded output signals, wherein processing of the one or more distributed input signals in the sub-encoders involves segmenting the one or more distributed input signals into segments for analysis, said segments having associated temporal durations which are dynamically variable at least partially in response to information content present in the one or more distributed input signals.

The invention is of advantage in that the method of encoding is capable of providing one or more of: perceptually better encoding quality, enhanced data compression.

Preferably, in the method, the segments of the one or more distributed input signals are processed mutually asynchronously in the sub-encoders. Such asynchronous operation is capable of enabling each sub-encoder to function optimally with regard to its respective aspect of signal processing executed in the method.

Preferably, in the method, the segments of the one or more distributed input signals with respect to each sub-encoder are at least partially temporally overlapping. Such overlapping is of benefit in that it reduces abrupt changes in signal characteristic from one segment to another temporally neighboring thereto.

Preferably, in the method, the sub-encoders are arranged to process the one or more distributed input signals in respect of at least one of: sinusoidal input signal information content, input signal waveform information content, input signal noise information content.

Preferably, in the method, the segmenting of the one or more distributed input signals involves at least one of:

(a) generating relatively longer segments for steady tones present in the one or more distributed input signals;

(b) generating relatively shorter segments for rapidly changing tones present in the one or more distributed input signals; and (c) arranging for segments to end substantially immediately preceding transients occurring in the one or more distributed input signals.

Such adaptation of the segments depending in input signal content is beneficial for improving the perceptual quality of encoding provided by the method.

Preferably, in the method, the encoded output signal is sub-divided into frames wherein each frame includes information relating to segments provided from the sub-encoders which commence within a temporal duration associated with the frame. This definition for the frames renders it easier to provide random access within a sequence of encoded data generated using the method. Thus, more preferably, in the method, the segments included within each frame are arranged in chronological order. Yet more preferably, in the method, each frame additionally includes parameter data describing a temporal duration between a temporal start of the frame and a first segment commencing after the frame's start.

Preferably, in the method, a number of segments included within each frame is dynamically variable depending upon information content present in the one or more distributed input signals.

According to a second aspect of the present invention, there is provided an encoder operable to process one or more input signals and generate corresponding one or more encoded output signals, the encoder being arranged to implement a method according to the first aspect of the invention.

According to a third aspect of the present invention, there is provided a decoder operable to receive one or more encoded output signals and decode them to generate one or more corresponding decoded signals, the decoder being arranged to be capable of processing the one or more encoded output signals as generated by a method according to the first aspect of the invention.

According to a fourth aspect of the present invention, there is provided a signal processing system arranged to include an encoder according to the second aspect of the invention and a decoder according to the third aspect of the invention.

According to a sixth aspect of the present invention, there is provided encoded output signal data generated by employing a method according to the first aspect of the invention, said data being conveyed by way of a data carrier. More preferably, the data carrier comprises at least one of a communication network and a data storage medium.

According to a seventh aspect of the present invention, there is provided software executable on computer hardware for implementing a method according to the first aspect of the invention.

It will be appreciated that features of the invention are susceptible to being combined in any combination without departing from the scope of the invention.

DESCRIPTION OF THE DIAGRAMS

Embodiments of the invention will now be described, by way of example only, with reference to the following diagrams wherein.

DESCRIPTION OF EMBODIMENTS OF THE INVENTION

Figure 1:
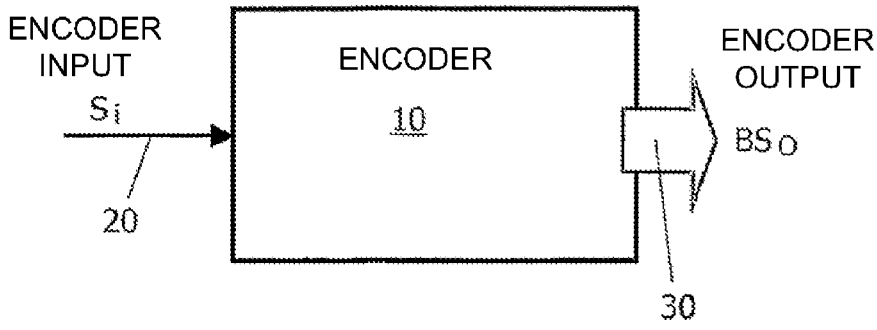
FIG. 1 is a schematic illustration of an encoder operable to receive an audio input signal and process it to generate a corresponding encoded output signal in the form of an encoded output bit-stream.

In FIG. 1, there is shown a known encoder 10 operable to receive an input signal 20, namely $S_I$, and encode the signal 20 to generate corresponding encoded output data 30, namely $BS_O$. The output data 30 is in the form of a bit-stream.

Figure 2:
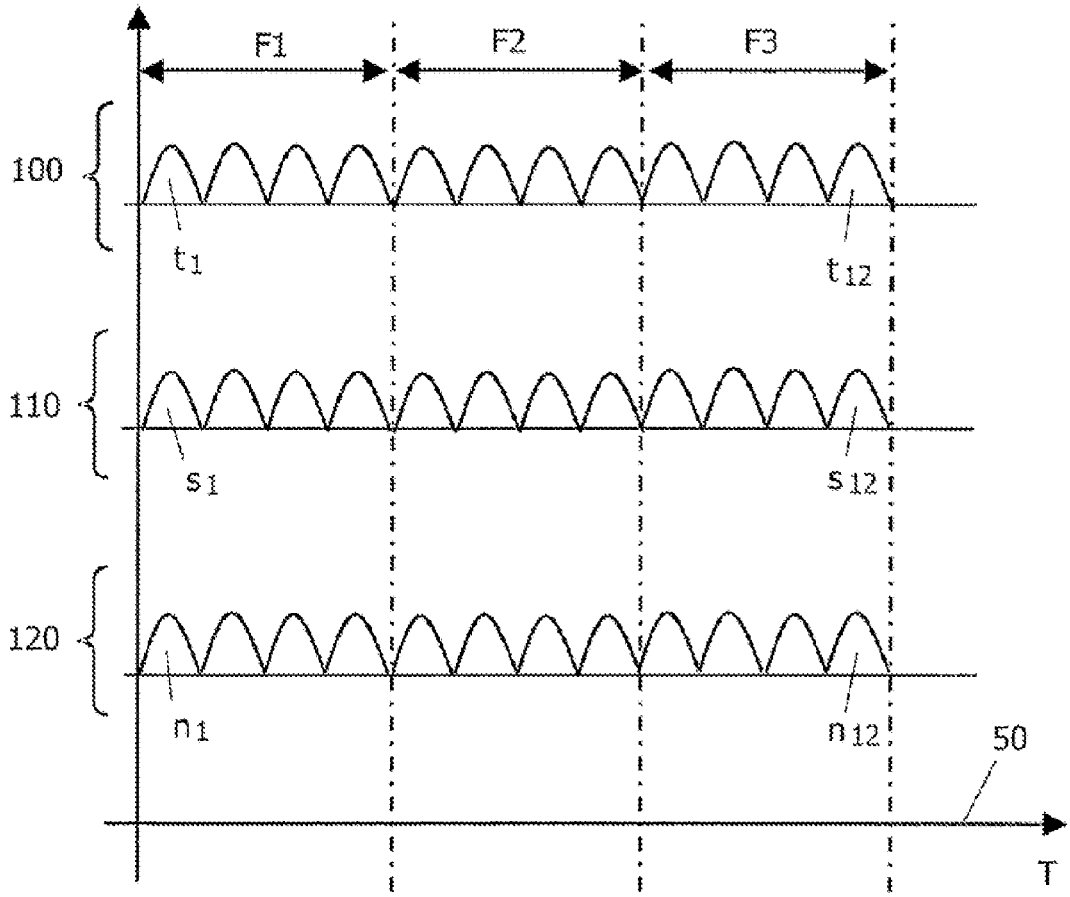
FIG. 2 is a temporal diagram illustrating processing occurring within the encoder of FIG. 1 utilizing fixed segmentation as known in the art.

Contemporary implementations of the encoder 10 rely on being able to divide the input signal 20 into segments of equal length as depicted in FIG. 2; to simplify description, arches in FIG. 2 indicate segment intervals where there is no mutual overlap although, in practice, some overlap is preferably utilized. The overlap employed in the encoder 10 is optionally arranged to be variable, for example made variable with response to information content in the input signal 20; beneficially, for transients present in the input signal 20, no or relatively little overlap is employed to avoid pre-echo effects arising. There is shown a temporal graph in FIG. 2 where elapsed time (T) is denoted by an abscissa axis 50. The signal 20 is divided into frames, for example frames F1, F2, F3, which are mutually of similar time duration. In the encoder 10, the signal 20 is analyzed and various types of parameters describing the signal 20 are determined; preferably, these parameters concern:

(a) transient signal information content denoted by 100;

(b) sinusoidal signal information content denoted by 110; and (c) noise-related signal information content denoted by 120.

Each frame F1 to F3 is further subdivided into segments in respect of each type of parameter as illustrated, for example the frames F1 to F3 comprise segments $t_1$ to $t_{12}$ regarding transient information content, segments $s_1$ to $s_{12}$ regarding sinusoidal information content, and segments $n_1$ to $n_{12}$ regarding noise information content. Each segment gives rise to one or more parameters describing a part of the signal 20 giving rise to the segment, these one or more parameters being included in the output 30.

An example of the encoder 10 is a proprietary Philips SSC codec which employs segments of substantially 16 ms duration wherein the segments are at least partially overlapped. Moreover, the codec employs three different sub-coding methods and is operable to output parameters associated with the segments into the bit-stream at the output 30 on a segment-by-segment basis, time-differentially where appropriate.

In the encoder 10, parameters from several consecutive segments form a corresponding frame: for example the frame F1 comprises the segments $t_1$ to $t_4$, $s_1$ to $s_4$ and $n_1$ to $n_4$. On account of the segments being of equal length, the frames F1 to F3 are also updated at a uniform rate. Moreover, each of the frames F1 to F3 is almost self-sufficient which renders the bit-stream output 30 suitable for streaming over a communication network, for example the Internet, or storing onto a data carrier providing for serial writing thereto and serial readout therefrom, for example an audio CD. In the graph of FIG. 2, although only three frames F1 to F3 are shown to illustrate fixed time-duration segmentation, it will be appreciated that the signal 20 is represented by more than three fixed-duration frames in the output signal 30 depending on duration of program content conveyed in the signal 20.

In case of packet-loss during transmission of the output 30, for example over a communication network such as the Internet or wireless network, error propagation for frames and segments of fixed duration will be limited, thereby potentially allowing for error concealment. Moreover, such fixed duration also allows for commencement of playback at almost any given time, and therefore corresponds substantially to random access.

Despite many beneficial characteristics arising from utilizing conventional fixed duration segments and associated frames, the inventors have appreciated that advantages can be derived from implementing the encoder 10 to employ segments having variable duration. Moreover, further benefits in terms of data compression and better subjective replay quality can be derived from employing different segments for each parameter type. In other words, variable segment duration in response to input signal content provides benefits regarding bit-rate and perceptual distortion.

In particular, the inventors have found that it is preferable:
(a) to employ relatively longer segments for substantially steady tones;
(b) to employ relatively shorter segments for rapidly changing tones; and
(c) to arrange segments to start immediately preceding, namely temporally in front of, transients in the input signal 20.

Thus, it is beneficial to employ mutually different time segmentation patterns for different sub-coding methods, namely generation of different parameter types, as will be described later with reference to FIG. 3.

Figure 3:
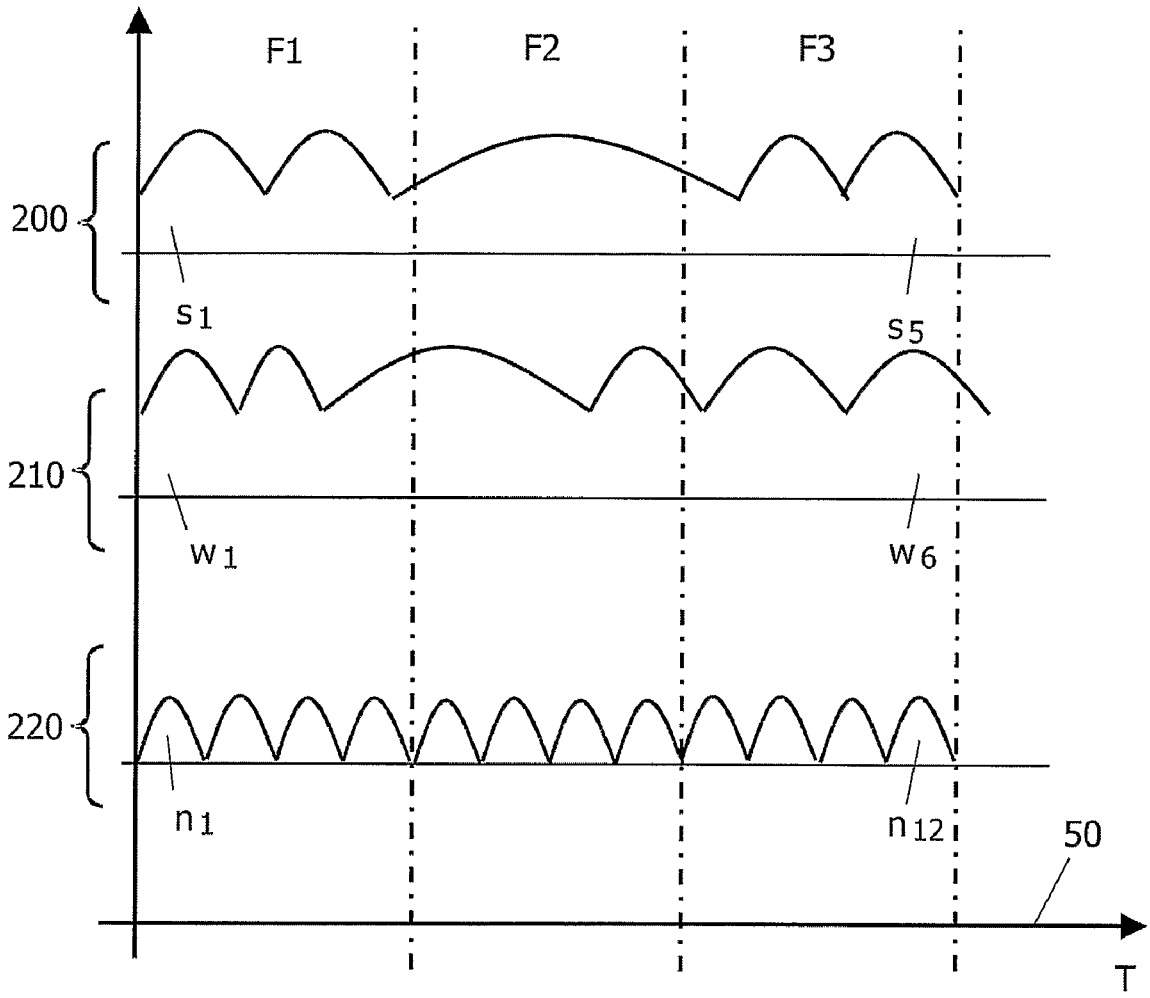
FIG. 3 is a temporal diagram illustrating processing occurring within the encoder of FIG. 1 utilizing variable segmentation according to the present invention.

In FIG. 3, there is shown a temporal graph of parameters output from the encoder 20 when implemented in a manner according to the present invention. The temporal graph includes the aforementioned abscissa axis 50 denoting time (T) and three types of parameter output, namely:
(a) segments $s_1$ to $s_{12}$ corresponding to parameters describing sinusoidal information present in the input signal 20, these segments being denoted by a group 200;
(b) segments $w_1$ to $w_{12}$ corresponding to parameters describing characteristics of waveforms present in the input signal 10, these segments being denoted by a group 210; and
(c) segments $n_1$ to $n_{12}$ corresponding to parameters describing noise information present in the input signal 20, these segments being denoted by a group 220.

Parameters corresponding to the groups 200, 210, 220 are combined to generate the output 30. It will be appreciated that the groups 200, 210, 220 preferably correspond to three sub-coders included within the encoder 20 as illustrated in FIG. 4, although it will be appreciated that other numbers of sub-coders are susceptible to being employed pursuant to the present invention.

Figure 4:
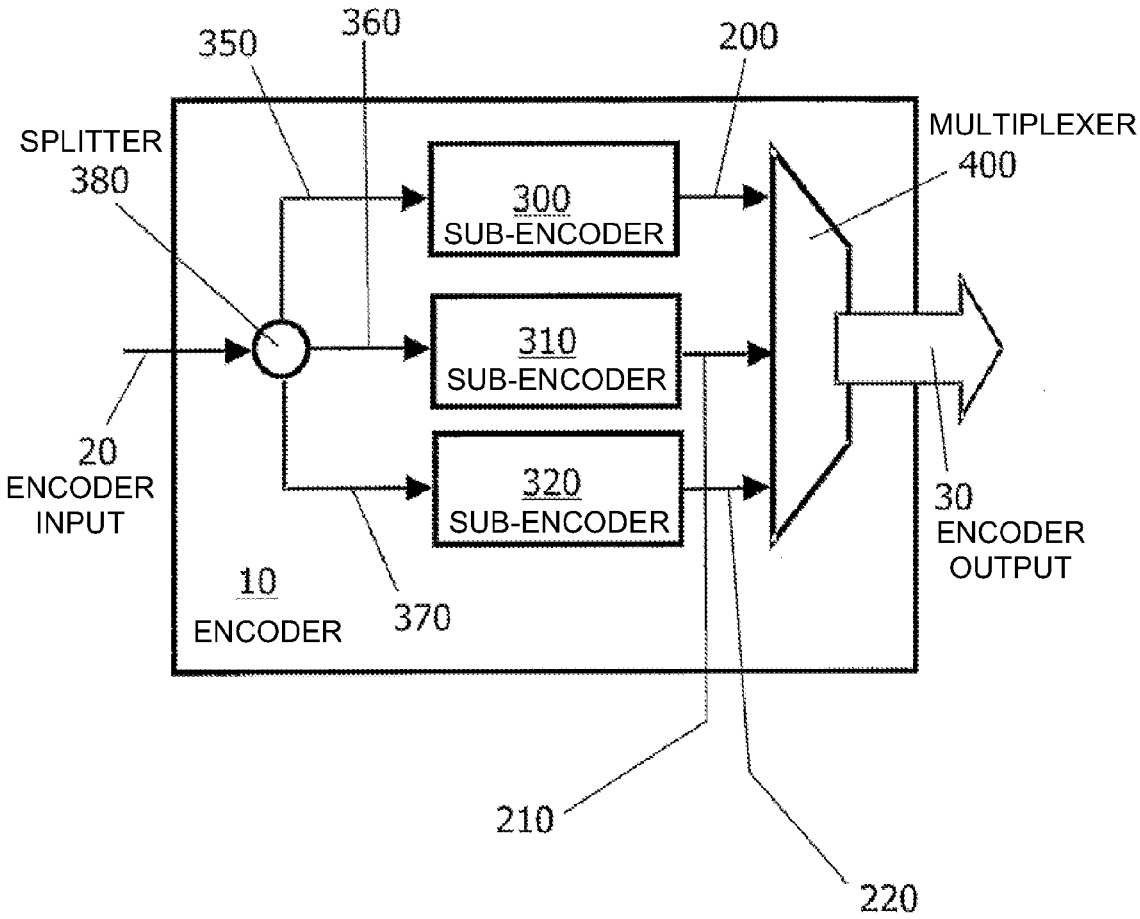
FIG. 4 is a schematic illustration of an encoder according to the invention, the encoder having its associated sub-encoders configured in a parallel manner.

In FIG. 4, the encoder 10 operable to output data as presented in FIG. 3 is implemented as shown where sub-coders 300, 310, 320 are coupled in parallel to receive input signals 350, 360, 370 respectively derived via a splitter 380 from the input signal 20 and generate corresponding parameter outputs corresponding to the parameter groups 200, 210, 220 respectively. Optionally, the splitter 380 is arranged to provide mutually similar input signals 350, 360, 370 to the sub-encoders 300, 310, 320. Alternatively, one or more of these input signals 350, 360, 370 can be arranged to be mutually different in order to assist processing executed within the encoder 10. The parameter outputs from the sub-coders 300, 310, 320 are connected to a multiplexer 400 which generates the output 30.

Several aspects are to be identified in FIG. 3 which differentiate it from FIG. 2, namely:
(a) the input signal 20 is represented by sinusoidal descriptive parameters, waveform descriptive parameters and noise descriptive parameters in contrast to FIG. 2 wherein transient descriptive parameters, sinusoidal parameters and noise descriptive parameters are employed;
(b) although nominal positions of the frames F1 to F3 are shown in FIG. 3, not all of the segments end at boundaries of the frames F1 to F3 in contradistinction to FIG. 2 wherein synchronism is shown;
(c) segments in the different groups 200, 210, 220 are of mutually different duration; and
(d) segments within each group 200, 210 have mutually different durations, although the encoder 10 is capable of supporting more regular constant duration segmentation, for example for the group 220, where information present in the input signal 20 with regard to noise content dictates that constant-duration segment encoding is beneficial; in other words, the encoder 10 operating according to the invention is preferably capable of switching between fixed segment duration and variable segment duration depending upon the nature of the input signal 20.

If required, the encoder 10 operating according to the invention can arrange for its parameter groups multiplexed at the output 30 to terminate simultaneously, thereby forming relatively larger frames; preferably, the output 30 from the encoder 10 operating according to the invention is subdivided into uniform frames of 100 ms length. Preferably, the duration of the frames is determined based on a target and a peak bit-rate constraints communicated to the encoder 10. These constraints are preferably defined by a communication network to which the encoder 10 is coupled.

In the output data 30 generated according to the invention, parameters associated with the segments are grouped into data packets in such a way that each packet carries information about all segments starting in a given frame. Such an arrangement of data is illustrated in FIG. 3.

Based on a segmentation pattern for the three frames illustrated in FIG. 3, the output data 30 includes a sequence of data as presented in Table 1:

TABLE 1

| Frame | Sequence of segment data packets included in the output 30 |
|---|---|
| 1 | $s_1$; $s_2$; $s_3$; $w_1$; $w_2$; $w_3$; $n_1$; $n_2$; $n_3$; $n_4$ |
| 2 | $w_4$; $n_5$; $n_6$; $n_7$; $n_8$ |
| 3 | $s_4$; $s_5$, $w_5$; $w_6$; $n_9$; $n_{10}$; $n_{11}$; $n_{12}$ |
| 4 | . . . |

The output 30 preferably also includes additional parameters conveying information concerning a distance between of a given frame and a first following segment thereto for each sub-coder. These additional parameters preferably represent a small proportion of the output data, for example less than 5%. Moreover, the inventors have found that intra-segment encoding is potentially as effective as time-differential encoding which, for example, intra-segment encoding allows for starting playback at a first segment in any given frame without experience encoded signal degradation, for example decoded audio quality degradation. An encoding scheme represented, for example, by Table 1 is also capable of providing random access and error concealment.

It will be appreciated that encoders according to the invention, for example as illustrated in FIG. 4, are susceptible of being implemented using one or more computing devices operating under software control. Alternatively, or additionally, the encoders are implementable in the form of application specific integrated circuits (ASICs).

Figure 5:
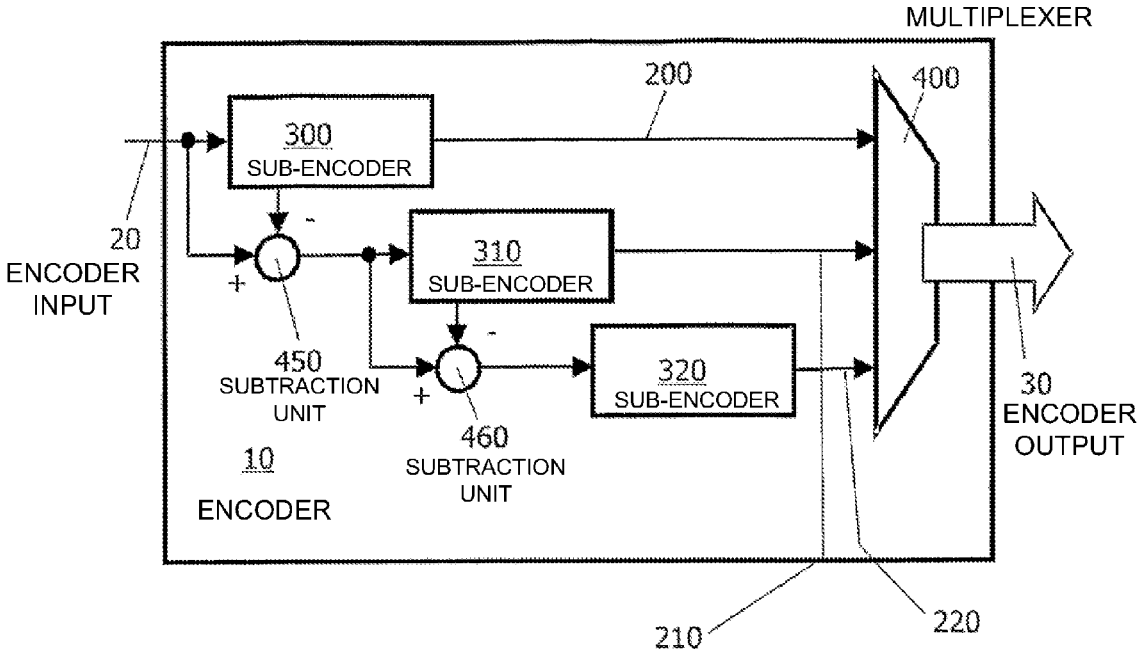
FIG. 5 is a schematic illustration of an encoder according to the invention, the encoder having its associated sub-encoders configured in a cascaded manner.

The encoder 10 illustrated in FIG. 4 is configured so that its sub-encoders 300, 310, 320 are arranged in a parallel manner. It will be appreciated that other configurations for the encoder 10 are also possible. For example, in FIG. 5, there is shown the encoder 10 with its sub-encoders 300, 310, 320 coupled in a cascaded manner by including two subtraction units 450, 460. Whereas the first sub-encoder 300 in FIG. 5 receives the input signal 20 distributed thereto, the second and third sub-encoders receive progressively residual signals as features of the input signal 20 are encoded into the output 30. The cascaded configuration for the encoder 10 presented in FIG. 5 is of benefit in that encoding errors, namely inaccuracies arising in operation of the sub-encoders, can at least partially be corrected by later sub-encoders 310, 320, thereby potentially resulting in perceptually better encoding quality in comparison to the encoder 10 of FIG. 4.

Figure 6:
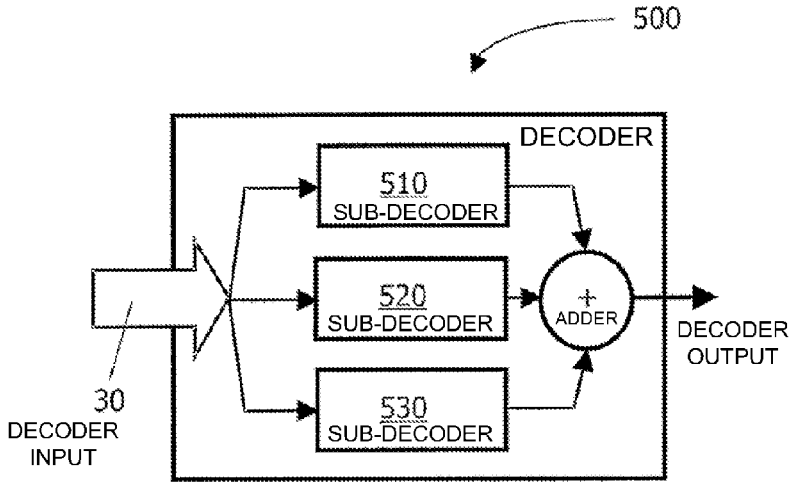
FIG. 6 is a schematic diagram of a decoder according to invention operable to decode encoded data generated by encoders according to the invention.

To complement the encoder according to the invention, corresponding decoders are operable to receive the output 30 and reconstitute a representation of the input signal $S_i$; for example, such a decoder is illustrated in FIG. 6 and indicated generally by 500. The decoder 500 is preferably implemented with a plurality of sub-decoders, for example sub-decoders 510, 520, 530 which are capable of operating mutually asynchronously to process the bit-stream output 30. Moreover, the decoder 500 is preferably implemented as one or more ASICs and/or software operating on computing hardware. Although the decoder 500 is shown with its sub-encoders 510, 520, 530 coupled in a parallel configuration, it will be appreciated that the decoder 500 can also be implemented in a cascaded manner akin to that of the encoder 10 illustrated in FIG. 5.

It will be appreciated that embodiments of the invention described in the foregoing are susceptible to being modified without departing from the scope of the invention as defined by the accompanying claims.

In the accompanying claims, numerals and other symbols included within brackets/parenthesize are included to assist understanding of the claims and are not intended to limit the scope of the claims in any way.

Expressions such as "comprise", "include", "incorporate", "contain", "is" and "have" are to be construed in a non-exclusive manner when interpreting the description and its associated claims, namely construed to allow for other items or components which are not explicitly defined also to be present. Reference to the singular is also to be construed in be a reference to the plural and vice versa.

The invention claimed is:

1. A method of encoding one or more input signals via an encoder to generate one or more corresponding encoded output signals, the method comprising:

(a) receiving, at an input of the encoder, the one or more input signals and distributing the one or more input signals, via a splitter, to sub-encoders of the encoder;

(b) processing, at the sub-encoders, the one or more input signals distributed to the sub-encoders with respect to one or more signal characteristics of the one or more distributed input signals to generate corresponding representative types of parameter outputs from the sub-encoders, wherein the representative types of parameter outputs include sinusoidal descriptive parameters, waveform descriptive parameters, and noise descriptive parameters; and (c) combining the parameter outputs of the sub-encoders, via a multiplexer, to generate the one or more encoded output signals of the encoder, wherein processing of the one or more distributed input signals in the sub-encoders involves segmenting the one or more distributed input signals into segments for analysis, said segments having associated temporal durations which are dynamically variable at least partially in response to information content present in the one or more distributed input signals, further wherein the segmenting includes dynamically variable signal segmenting of the one or more distributed input signals employing mutually different time segmentation patterns for different sub-coding corresponding to generation of different parameter types of respective sub-coders within the encoder and comprises:

(i) generating relatively longer segments for steady tones present in the one or more distributed input signals;

(ii) generating relatively shorter segments for rapidly changing tones present in the one or more distributed input signals; and (iii) arranging for segments to end substantially immediately preceding transients occurring in the one or more distributed input signals, wherein the encoded output signal of the encoder is sub-divided into frames, each frame including information relating to all segments of the different parameter types provided from the sub-encoders which commence within a temporal duration associated with a respective frame, further wherein not all of the segments end at boundaries of the frames, and further wherein segments of different groups of parameter types of sinusoidal information, waveform information, and noise information are of mutually different duration, and still further wherein segments within each group of a respective parameter type of sinusoidal information and waveform information have mutually different durations.

2. The method according to claim 1, further comprising:

arranging the sub-encoders in a cascaded manner via subtraction units to accommodate progressively residual encoding residues of encoding errors arising from earlier sub-encoders and partially corrected by later sub-encoders of the sub-encoders.

3. The method of encoding according to claim 1, wherein the segments of the one or more distributed input signals are processed mutually asynchronously in the sub-encoders.

4. The method according to claim 1, wherein the segments of the one or more distributed input signals with respect to each sub-encoder are at least partially temporally overlapping.

5. The method according to claim 1, wherein the processing at the sub-encoders includes processing the one or more distributed input signals with respect to: (i) sinusoidal input signal information content, (ii) input signal waveform information content, and (iii) input signal noise information content.

6. The method according to claim 1, wherein the encoded output signal is sub-divided into frames wherein each frame includes parameters associated with the segments, grouped into data packets, wherein each data packet carries information relating to all segments provided from the sub-encoders which commence within a temporal duration associated with the corresponding frame.

7. The method according to claim 6, wherein the segments included within each frame are arranged in chronological order.

8. The method according to claim 7, wherein each frame additionally includes parameter data describing a temporal duration between a temporal start of the frame and a first segment commencing after the frame's start.

9. The method according to claim 6, wherein a number of segments included within each frame is dynamically variable depending upon information content present in the one or more distributed input signals.

10. A decoder operable to receive one or more encoded output signals and decode the one or more encoded output signals to generate one or more corresponding decoded signals, the decoder being configured to process the one or more encoded output signals as generated by a method according to claim 1.

11. A non-transitory computer-readable medium embodied with computer program code for being loaded into a memory and executable on computer hardware for implementing a method according to claim 1.

12. An encoder operable to process one or more input signals and generate corresponding one or more encoded output signals, the encoder comprising:

(a) an input for receiving the one or more input signals and a splitter for distributing the one or more input signals to sub-encoders of the encoder;

(b) the sub-encoders for processing the one or more input signals distributed to the sub-encoders with respect to one or more signal characteristics of the one or more distributed input signals to generate corresponding representative types of parameter outputs from the sub-encoders, wherein the representative types of parameter outputs include sinusoidal descriptive parameters, waveform descriptive parameters, and noise descriptive parameters; and (c) a multiplexer for combining the parameter outputs of the sub-encoders to generate the one or more encoded output signals of the encoder, wherein processing of the one or more distributed input signals in the sub-encoders involves segmenting the one or more distributed input signals into segments for analysis, said segments having associated temporal durations which are dynamically variable at least partially in response to information content present in the one or more distributed input signals, further wherein the segmenting includes dynamically variable signal segmenting of the one or more distributed input signals employing mutually different time segmentation patterns for different sub-coding corresponding to generation of different parameter types of respective sub-coders within the encoder and comprises:

(i) generating relatively longer segments for steady tones present in the one or more distributed input signals;

(ii) generating relatively shorter segments for rapidly changing tones present in the one or more distributed input signals; and (iii) arranging for segments to end substantially immediately preceding transients occurring in the one or more distributed input signals, wherein the encoded output signal of the encoder is subdivided into frames, each frame including information relating to all segments of the different parameter types provided from the sub-encoders which commence within a temporal duration associated with a respective frame, further wherein not all of the segments end at boundaries of the frames, and further wherein segments of different groups of parameter types of sinusoidal information, waveform information, and noise information are of mutually different duration, and still further wherein segments within each group of a respective parameter type of sinusoidal information and waveform information have mutually different durations.

13. A signal processing system arranged to include an encoder according to claim 11 and a decoder according to claim 10.

14. A non-transitory data storage medium encoded with data representing an encoded input signal, the encoded input signal having been encoded via a method comprising:

(a) receiving, at an input of the encoder, the one or more input signals and distributing the one or more input signals, via a splitter, to sub-encoders of the encoder;

(b) processing, at the sub-encoders, the one or more input signals distributed to the sub-encoders with respect to one or more signal characteristics of the one or more distributed input signals to generate corresponding representative types of parameter outputs from the sub-encoders, wherein the representative types of parameter outputs include sinusoidal descriptive parameters, waveform descriptive parameters, and noise descriptive parameters; and (c) combining the parameter outputs of the sub-encoders, via a multiplexer, to generate the one or more encoded output signals of the encoder, wherein processing of the one or more distributed input signals in the sub-encoders involves segmenting the one or more distributed input signals into segments for analysis, said segments having associated temporal durations which are dynamically variable at least partially in response to information content present in the one or more distributed input signals, further wherein the segmenting includes dynamically variable signal segmenting of the one or more distributed input signals employing mutually different time segmentation patterns for different sub-coding corresponding to generation of different parameter types of respective sub-coders within the encoder and comprises:

(i) generating relatively longer segments for steady tones present in the one or more distributed input signals;

(ii) generating relatively shorter segments for rapidly changing tones present in the one or more distributed input signals; and (iii) arranging for segments to end substantially immediately preceding transients occurring in the one or more distributed input signals, wherein the encoded output signal of the encoder is subdivided into frames, each frame including information relating to all segments of the different parameter types provided from the sub-encoders which commence within a temporal duration associated with a respective frame, further wherein not all of the segments end at boundaries of the frames, and further wherein segments of different groups of parameter types of sinusoidal information, waveform information, and noise information are of mutually different duration, and still further wherein segments within each group of a respective parameter type of sinusoidal information and waveform information have mutually different durations.

* * * * *